United States Patent [19]

Vesborg

[11] Patent Number: 4,893,726

[45] Date of Patent: Jan. 16, 1990

[54] CONTAINER FOR CONTROLLED RELEASE OF A PREFERABLY LIQUID MEDIUM

[75] Inventor: Steen Vesborg, Bruxelles, Belgium

[73] Assignee: Colgate-Palmolive Company, Piscataway, N.J.

[21] Appl. No.: 221,700

[22] Filed: Jul. 20, 1988

[51] Int. Cl.[4] ..... B65D 47/00

[52] U.S. Cl. ..... 220/403; 222/485; 222/529; 222/478; 222/158

[58] Field of Search ..... 206/0.5; 220/403; 252/90; 222/539, 529, 531, 501, 512, 559, 485, 519, 520, 158; 4/228

[56] References Cited

U.S. PATENT DOCUMENTS

| | | | |
|---|---|---|---|
| 186,971 | 12/1859 | Chakine | 222/529 |
| 2,086,631 | 7/1937 | Munro | 222/485 |
| 2,328,020 | 8/1943 | Johnson | 222/520 |
| 2,912,842 | 10/1959 | Tingley, Jr. | 68/24 |
| 3,181,744 | 5/1965 | Hales | 222/539 |
| 3,193,388 | 7/1965 | Conrey | 206/0.5 |
| 3,291,331 | 12/1966 | Grisham | 222/529 |
| 3,365,106 | 1/1968 | Lodding et al. | 222/485 |
| 3,400,808 | 9/1968 | Richten | 206/5 |
| 3,613,966 | 10/1971 | Summers | 222/529 |
| 4,014,105 | 3/1977 | Furgal et al. | 34/12 |
| 4,318,891 | 3/1982 | Kim | 222/485 |
| 4,407,779 | 10/1983 | Thompson | 422/266 |
| 4,452,382 | 6/1984 | Von Holdt | 222/529 |
| 4,483,465 | 11/1984 | Lawrence | 222/512 |
| 4,545,917 | 10/1985 | Smith et al. | 252/90 |
| 4,606,775 | 8/1986 | Robinson et al. | 252/90 |
| 4,632,282 | 12/1986 | Nagashima | 222/529 |
| 4,703,872 | 11/1987 | Cornette et al. | 222/158 |

FOREIGN PATENT DOCUMENTS

| | | | |
|---|---|---|---|
| 0044034 | 1/1982 | European Pat. Off. | 4/228 |
| 0201376 | 11/1986 | European Pat. Off. . | |
| 0216415 | 4/1987 | European Pat. Off. . | |
| 0230079 | 7/1987 | European Pat. Off. . | |
| 0269543 | 6/1988 | European Pat. Off. . | |
| 0288345 | 10/1988 | European Pat. Off. . | |
| 589065 | 2/1959 | Italy | 206/0.5 |
| 728644 | 12/1966 | Italy | 222/531 |

*Primary Examiner*—Stephen Marcus
*Assistant Examiner*—Stephen Castellano
*Attorney, Agent, or Firm*—Richard J. Ancel; Robert C. Sullivan; Murray M. Grill

[57] ABSTRACT

A doser for controlled release of a preferably liquid medium, such as a liquid detergent, comprising a container and a locking and dosage insert connected to the container. The container is provided with an inwardly directed flange part for forming a container opening, and the dosage insert comprises a flange-like counterpart which abuts the flange part of the container and forms an opening which extends into the container. The insert also includes a locking and dosage part which is adapted for arrangement of the insert in locking and insertion positions in the container opening. The insert includes a number of shovel-shaped blades connected to the inner rim of the counterpart via thin-walled hinge areas. The blades abut with their upper terminal surfaces the inner surface of the flange part of the container in a locked position and extend convergingly from said upper terminal surfaces into the inside of the container, where they are connected to a connection body via thin-walled hinge areas. A very secure and reliable connection between the insert and the container is obtained, since in its locked position the locking and dosage part of the insert presses the counterpart against the flange part of the container and is itself situated in the inside of the container so that it cannot from outside be forced to leave this locked position. The locking and dosage part causes a controlled release of detergent, since its shovel-shaped blades obstruct the inflow of water into the inside of the doser and the outflow of detergent from the doser.

14 Claims, 3 Drawing Sheets

CONTAINER FOR CONTROLLED RELEASE OF A PREFERABLY LIQUID MEDIUM

FIELD OF THE INVENTION

The present invention relates to a doser for controlled release of a preferably liquid medium, such as a liquid detergent, comprising a container and a locking and dosage insert connected to said container.

DESCRIPTION OF THE PRIOR ART

It is in principle known to use a doser comprising two halves, one or both of which being provided with openings or the more or less controlled release of a medium inside the doser to another medium, said doser either bing in contact with or immersed in said medium. If this principle is to be used for the controlled release of e.g. a liquid detergent in the drum of a washing machine, the detergent is to be released in such a way as not to come into direct contact with the clothes in a too concentrated form, thus damaging the clothes. Furthermore the doser must be able to resist the strong actions it is subjected to during the washing process, especially during spin-drying, without running the risk of being broken or separated, since any sharp edges formed or exposed in the breakage can damage the clothes.

DISCLOSURE OF THE INVENTION

The doser according to the invention is characterized by the container being provided with an inwardly directed flange part for forming a container opening, and the locking and dosage insert comprising a flange-like counterpart abutting the flange part of the container and, while forming an opening, extending substantially complementary to said flange part in the direction towards the inside of the container, and a locking and dosage part, said part being able to occupy two stable positions, in relation to the counterpart, and possessing a number of shovel-shaped blades connected to the inner rim of the counterpart via thin-walled areas acting as hinges, said blades with their upper terminal surfaces abutting the inner surface of the flange part of the container in a locked position and extending convergingly from said upper terminal surfaces into the inside of the container where they are connected to a connection body via thin-walled areas which act as hinges.

Thus a very secure and reliable connection between the insert and the container is obtained, since in its locked position the locking and dosage part of the insert presses the counterpart against the flange part of the container and is itself situated in the inside of the container so that it cannot from outside be forced to leave this locked position. At the same time the locking and dosage part causes a controlled release of detergent, since its shovel-shaped blades obstruct the inflow of water into the inside of the doser as well as the outflow of detergent from the doser.

According to the invention the locking and dosage part in an insertion position of the dosage insert extends upwards through the opening of the counterpart from the connection areas between the locking and dosage part and the counterpart.

Thus the terminal surfaces of the shovel-shaped blades are situated on a diameter smaller than the diameter of the opening of the container in the insertion position of the insert. When the locking and dosage part is passed through the opening in the counterpart and into its locked position, the terminal surfaces of the blades for larger than that of the container opening. As a result, there is provided a large radial abutment surface between the terminal surfaces of the blades and the inner surface of the flange part of the container and thus a very secure coupling between the container and the insert is obtained.

Furthermore the blades of the locking and dosage insert are according to the invention of double curvature.

Thus an additional obstruction of water inflow into the doser as well as detergent outflow out of the doser is obtained.

Moreover, the connection body of the locking and dosage insert is, according to the invention, a cup-shaped body provided with an inner, transverse rib, the cavity of said body facing the opening of the dosage insert.

When the position of the dosage insert is to be changed from the insertion position to the locked position it is possible to turn the locking and dosage part by inserting a special tool into the connection body while the part is passed through the opening of the counterpart.

Furthermore, a slotted cylinder corresponding to the shovel-shaped blades extends, according to the invention, from the inner rim of the counterpart of the locking and dosage insert into the inside of the container. Moreover, the cylinder extends, according to the invention, down to the bottom of the container, where the lower end of said cylinder abuts a circular abutment surface.

Thus an additional obstruction of water inflow into the doser as well as detergent outflow out of the doser is obtained, and the rigidity of the doser is increased, especially in the axial direction. This is of great importance when the dosers are to be stacked or put on top of caps belonging to detergent dosers to be stacked.

BRIEF DESCRIPTION OF THE DRAWINGS

Further properties of the doser according to the invention are described in the claims and below where the invention is described in greater detail with reference to the accompanying drawings where

DESCRIPTION OF THE PREFERRED EMBODIMENTS

Figure 1:
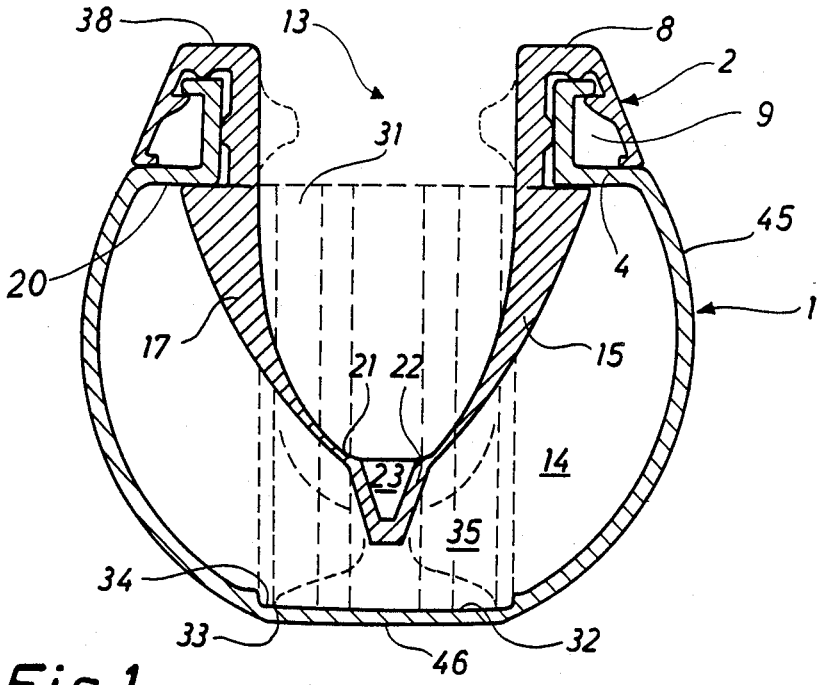
FIG. 1 shows a vertical section through an embodiment of a doser according to the invention comprising a container and a locking and dosage insert and where the dosage insert is in a locked or operational position.

FIGS. 1 to 4 show an embodiment of the doser according to the invention comprising a container 1 and a locking and dosage insert 2 connected to said container. The substantially spherical container is provided with an inwardly directed flange part 4 for forming a container opening 3, said flange part comprising an inwardly directed shoulder 5 continuing into an upwardly directed neck 6, said neck at its upper end being provided with an outwardly directed collar 7.

The locking and dosage insert 2 comprises a flange-like counterpart B and a locking and dosage part 15. The counterpart S abuts and envelopes the flange part 4 of the container 1, since it is provided with a circular groove 9 for receiving the neck 6 of the flange part 4 and comprises an outer wall 10, an upper wall 11 and an inner wall 12. The inner wall 12 extends towards the inside 14 of the container substantially parallel to the neck 6 of the flange part 4.

Figure 2:
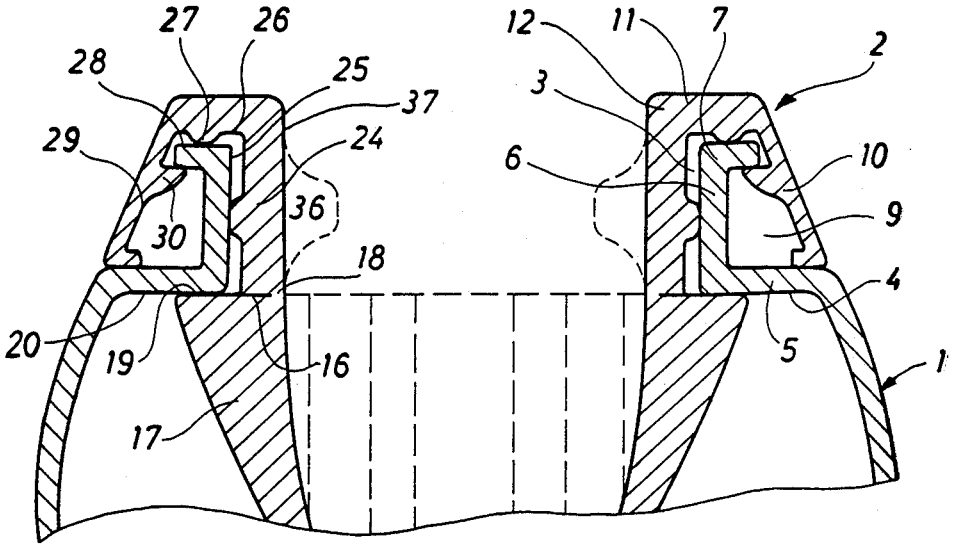
FIG. 2 shows a segment of the above section in a larger scale.
Figure 3:
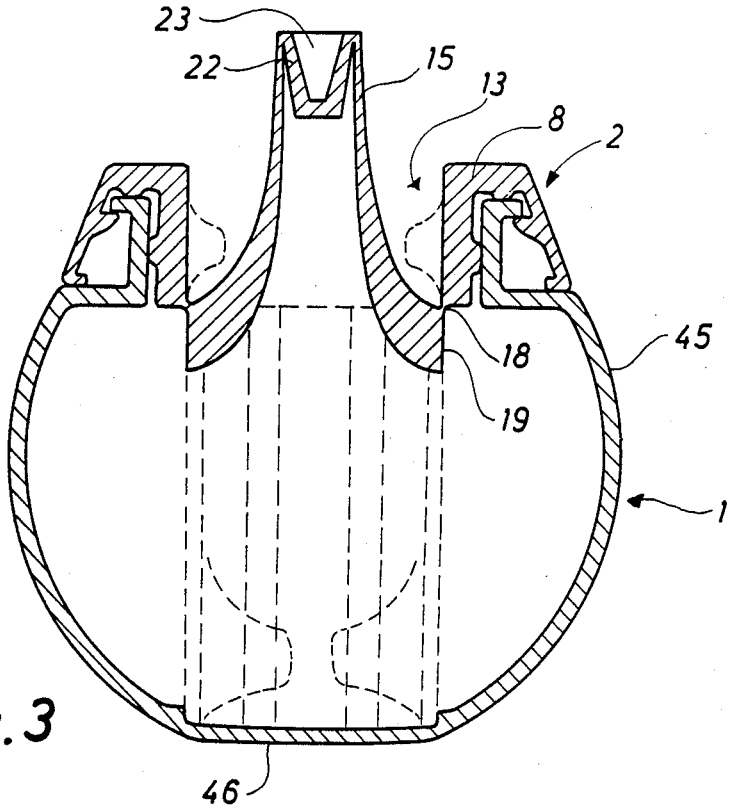
FIG. 3 shows the doser of FIG. 1 where the locking and dosage insert is in its insertion position.
Figure 4:
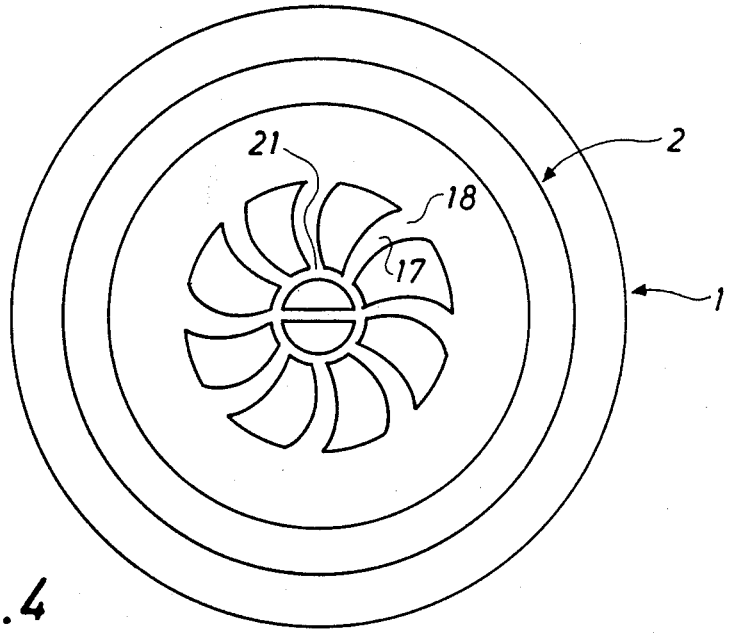
FIG. 4 is a top view of the above.

The locking and dosage part 15 of the dosage insert 2 is able to occupy two positions in relation to the counterpart 8, i.e. an insertion position, as shown in FIGS. 3 and 4, and a locked position, as shown in FIGS. 1 and 2. The locking and dosage part 15 is provided with a number of shovel-shaped blades 17 which are connected to the inner rim 16 of the inner wall 12 of the counterpart 8 via thin-walled hinge areas 18. These shovel-shaped blades 17 possess upper terminal surfaces 19 abutting, as shown in the locked position in FIG. 1, the inner surface 20 of the flange part 4 of the container 1. The blades 17 extend convergingly from said upper terminal surfaces 19 into the inside 14 of the container where they are connected with a cup-shaped connection body 22 via thin-walled hinge areas 21. The cavity of said connection body 22 faces the opening 13 of the locking and dosage insert 2 and is provided with an inner, transverse rib 23.

In its other stable position, i.e. its insertion position, the locking and dosage part 15 of the dosage insert 2 extends upwards through the opening 13 of the counterpart 8 from the hinge areas 18 between the locking and dosage part 15 and the counterpart 8, cf. FIG. 3. In this position the terminal surfaces 19 of the blades 17 are situated on a diameter smaller than the diameter of the opening 3 of the container. A special tool inserted into the cup-shaped connection body 22 includes a groove corresponding to the ib 23 to move the locking and dosage part 15 through opening 13 of the counterpart 8 and into its locked position. In this orientation the terminal surfaces of the blades 17 form a diameter larger than that of the container opning 3, and thus lock the assembly against the inner surface 20 of the flange part 4 of the container 1. By means of the special tool the inner transverse rib 23 serves to turn the cup-shaped connection body 22 in relation to the counterpart S when the connection body 22 and thus the locking and dosage part 15 are passed through the opening 13 of the counterpart 8. Such a turning facilitates the passing or pressing through of the locking and dosage part.

In the embodiment shown in FIGS. 1 to 4 the circular groove 9 of the counterpart 8 on the inner wall 12 possesses a seal in the form of a circular bead 24 abutting the outer surface 25 of the neck 6 of the flange part 4 when the insert 2 is locked to the container 1, thus forming a tight seal. On the inner surface 26 of the upper wall 11 of the counterpart 8 there is a corresponding seal in the form of a circular bead 27 which presses against the outer surface 2S of the collar 7 of the flange part 4, thus forming a tight seal when the locking and dosage part 15 of the dosage insert 2 is in its locked position. Finally there are a number of locking means 30 on the inner surface 29 of the outer wall 10 of the counterpart 8 which latch under the collar 7 of the flange part 4.

A cylinder 31 (shown with dashed lines) extends into the inside 14 of the container 1 from the inner rim 16 of the counterpart B of the dosage insert 2 to the inner bottom 32 of the container 1, where the lower end 33 of said cylinder abuts a circular abutment surface 34 in the inside 14 of the container. The cylinder 31 includes slots which are aligned with the shovel-shaped blades 17 to permit orientation of the locking and dosage part 15 in the insertion and locking position. See FIGS. 1 and 4. At its lower end the cylinder is provided with a number of inwardly directed shovel blades 35 (shown with dashed lines). Correspondingly shovel blades 36 (shown with dashed lines) extend inward from the inner surface 37 of the inner wall 12. As previously mentioned, the shovel blades obstruct the inflow of water into the inside of the doser and the outflow of detergent from the doser, thereby resulting in controlled release of detergent.

Figure 5:
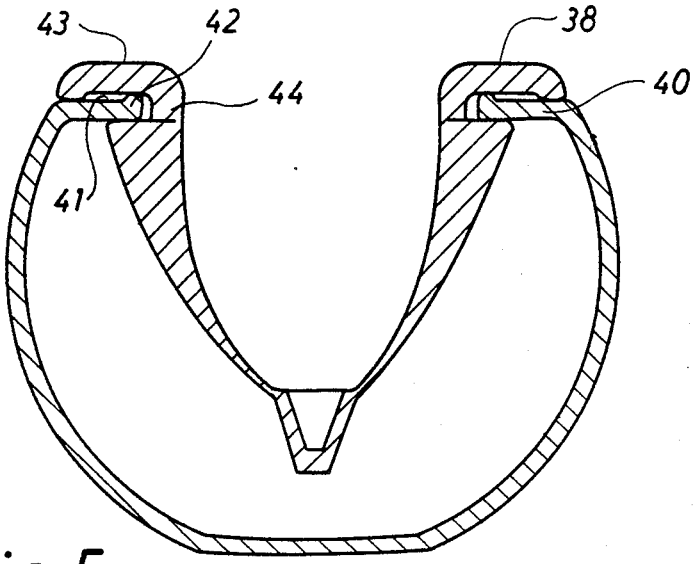
FIG. 5 shows a vertical sectional view through another embodiment of the doser according to the invention.

FIG. 5 shows an alternative embodiment of the doser according to the invention in which the flange part of the container includes an inwardly directed flange 40 having a seal in the form of a circular bead 42 on its outer surface. In this embodiment the counterpart of the dosage insert has a L-shaped cross-section and includes a web 43 which abuts the outer surface 41 of the flange part of the container, and another web 44 which extends along the inner periphery of the flange part towards the inside of the container. With its inner rim, just like in the embodiment shown in FIGS. 1 to 4, the flange part is connected to the locking and dosage part, which has a shape corresponding to that of the embodiment shown in FIGS. 1 to 4, via thin-walled hinge areas. This embodiment does not include a slotted cylinder for increasing the rigidity of the doser or the shovels in the inlet.

In both embodiments, the exterior surfaces of the doser are formed in such a way as not to possess sharp edges to prevent damage to clothes while the doser is in use. In the connection area between the container and the insert the flange part of the dosage insert projects smoothly into the container.

The doser according to the invention may be either of the disposable type, since it is filled with the necessary amount of detergent at the factory and its opening is closed by means of a piece of foil welded to the doser at the upper surface 3B of the insert, or it may be supplied without detergent. In the latter case the opening 13 is suitably dimensioned in such a way as to allow the doser to be put on the cap of the container in which the detergent is supplied and thus being attached thereto when supplied. The doser according to the invention is made of transparent or translucent material and provided with one or more measuring indications 45 so that the user may fill the doser himself with the necessary amount of detergent. In this respect the container possesses a flat bottom 46 so that the doser remains stable when it is filled with detergent. In the case of the doser being supplied already filled with detergent it is also reasonable with respect to the filling at the factory to equip the container with a flat bottom.

The container as well as the dosage insert are made of plastic, preferably polypropylene, and for the manufacture of the container injection blow molding or extrusion molding is preferably used, while injection molding is used for the manufacture of the dosage insert. The dosage insert is preferably molded in its insertion position.

The invention may be varied in many ways without deviating from the scope of the invention. Thus both the shovel blades 36 and the slotted cylinder 31,of the embodiment shown in FIGS. 1 to 4 may be omitted. Moreover, it may be suitable to weld the flange part of the container to the counterpart of the dosage insert, e.g. by using ultrasonic welding, heat sealing or spin welding, in order to further secure the connection between the insert and the container.

I claim:

1. A locking apparatus adapted for coupling to a container including a flange part which extends inwardly in a radial direction to define a container opening, the flange part having an inner surface, the container opening being centered on a longitudinal axis normal to the radial direction, the locking apparatus comprising a locking insert removably inserted in the container opening, the locking insert including a counterpart fitted within said container opening, a locking part, and an insert opening, said locking part including a first blade having one end which is swingably hinged by a first hinge part to said counterpart, and another end thereof hingably joined by a second hinge part to a connection body positioned in said insert opening, said one end of said first blade having an abutting surface, and said connection body being being movable longitudinally along said axis between first and second stable positions, so that when said connection body is in said first stable position, said abutting surface of said one end of said first blade extends radially inward of said container opening, thereby allowing insertion of said locking insert in said container opening, and when said connection body is moved to said second stable position, said first blade swings on said first and second hinge parts to extend said abutting surface radially outward and in abutment against said inner surface of said flange part, thereby locking said locking insert in said container opening.

2. A locking apparatus according to claim 1, wherein said flange part is formed by a shoulder which extends inwardly in the radial direction and continues into a neck extending upwardly in the longitudinal direction, said neck having a collar at an upper end thereof which extends outwardly in the radial direction, and said counterpart is formed with an upper portion having a circular groove for receiving said flange part.

3. A locking apparatus according to claim 2, wherein said groove includes means for latching said collar of said flange part.

4. A locking apparatus according to claim 1, wherein said counterpart includes a circular bead on an outer surface thereof for forming a ring seal with said flange part.

5. A locking apparatus according to claim 1, wherein said first blade of said locking part has a curved configuration.

6. A locking apparatus according to claim 1, wherein said connection body is a cup-shaped body.

7. A locking apparatus according to claim 6, wherein said cup-shaped body includes an inner transverse rib which faces upwardly relative to said insert opening.

8. A locking apparatus according to claim 1, wherein said locking insert includes a cylinder which extends from an inner rim of said counterpart into the inside of said container and has a slot formed therein which is aligned with said first blade.

9. A locking apparatus according to claim 8, wherein said cylinder extends down to a bottom portion of said container and abuts an annular abutment surface formed on said bottom portion.

10. A locking apparatus according to claim 8, wherein said cylinder includes a shovel blade which extends radially into the container.

11. A locking apparatus according to claim 1, wherein said counterpart includes a shovel blade which extends radially into said insert opening.

12. A locking apparatus according to claim 1 adapted for the controlled release of a liquid medium such as a viscous liquid detergent, wherein said locking insert further comprises a second blade circumferentially spaced from said first blade, and a cylinder which extends from an inner rim of said counterpart into the inside of said container, said cylinder comprising first and second slots which are respectively aligned with said first and second blades.

13. A locking apparatus according to claim 12, wherein said cylinder includes a shovel blade which extends radially inwardly into the container.

14. A locking apparatus according to claim 12, wherein said connection body is a cup-shaped body.

* * * * *

UNITED STATES PATENT AND TRADEMARK OFFICE

CERTIFICATE OF CORRECTION

PATENT NO. : 4,893,726

DATED : January 16, 1990

INVENTOR(S) : Steen Vesborg

It is certified that error appears in the above-identified patent and that said Letters Patent is hereby corrected as shown below:

ON TITLE PAGE:

Claims priority of Danish Patent Application No. 3852/87, filed July 23, 1987

Signed and Sealed this

Tenth Day of March, 1992

*Attest:*

HARRY F. MANBECK, JR.

*Attesting Officer*

*Commissioner of Patents and Trademarks*